US008494425B2

(12) United States Patent
Tanda

(10) Patent No.: US 8,494,425 B2
(45) Date of Patent: Jul. 23, 2013

(54) FIXING UNIT AND IMAGE FORMING APPARATUS WITH BUILT-IN FIXING UNIT

(75) Inventor: Tetsuo Tanda, Osaka (JP)

(73) Assignee: Kyocera Mita Corporation (JP)

( * ) Notice: Subject to any disclaimer, the term of this patent is extended or adjusted under 35 U.S.C. 154(b) by 198 days.

(21) Appl. No.: 13/169,266

(22) Filed: Jun. 27, 2011

(65) Prior Publication Data

US 2011/0318076 A1 Dec. 29, 2011

(30) Foreign Application Priority Data

Jun. 29, 2010 (JP) ..... 2010-147820

(51) Int. Cl.
*G03G 15/20* (2006.01)

(52) U.S. Cl.
USPC ..... 399/329; 399/122; 399/328

(58) Field of Classification Search
USPC ..... 399/329, 328, 320, 122; 219/216
See application file for complete search history.

(56) References Cited

U.S. PATENT DOCUMENTS

| | | | | |
|---|---|---|---|---|
| 6,498,911 | B2 * | 12/2002 | Hiroki et al. | 399/69 |
| 7,412,197 | B2 * | 8/2008 | Jang | 399/333 |
| 7,831,188 | B2 * | 11/2010 | Lee | 399/329 |
| 2002/0136562 | A1 | 9/2002 | Hiroki et al. | |
| 2003/0053830 | A1 * | 3/2003 | Hachisuka et al. | 399/329 |
| 2005/0078980 | A1 * | 4/2005 | Hong | 399/122 |
| 2006/0165446 | A1 * | 7/2006 | Kikuchi | 399/329 |
| 2007/0201914 | A1 * | 8/2007 | Tsuji et al. | 399/328 |
| 2012/0328338 | A1 * | 12/2012 | Nawa et al. | 399/328 |

FOREIGN PATENT DOCUMENTS

| | | | |
|---|---|---|---|
| JP | 5-332353 | | 12/1993 |
| JP | 05332353 | A * | 12/1993 |
| JP | 2007-86267 | | 4/2007 |

* cited by examiner

*Primary Examiner* — David Gray
*Assistant Examiner* — Carla Therrien
(74) *Attorney, Agent, or Firm* — Gerald E. Hespos; Michael J. Porco; Matthew T. Hespos

(57) ABSTRACT

A fixing unit for fixing a toner image formed on a sheet is provided with a belt unit including a belt configured to press the sheet, a reference roller configured to nip the sheet in cooperation with the belt, and a supporting element configured to support the belt unit and the reference roller. The belt unit includes first and second rollers on which the belt is wound. The supporting element includes a supporting plate configured to support the first, second and reference rollers.

9 Claims, 16 Drawing Sheets

FIXING UNIT AND IMAGE FORMING APPARATUS WITH BUILT-IN FIXING UNIT

BACKGROUND OF THE INVENTION

1. Field of the Invention

The present invention is related to a fixing unit for fixing a toner image to a sheet and an image forming apparatus with the built-in fixing unit.

2. Description of the Related Art

An image forming apparatus such as a copier, a facsimile machine or a printer typically includes a fixing unit configured to fix a toner image to a sheet. A certain type of the fixing unit includes a heating roller and a pressure roller configured to press the heating roller. While a sheet bearing a toner image passes through a nip portion between the heating and pressure rollers, the toner image is fixed to the sheet.

Another type of the fixing unit includes a heated belt and a pressure roller configured to press the belt. While a sheet passes through a nip portion between the belt and the pressure roller, a toner image is fixed to the sheet.

The aforementioned belt-type fixing unit includes a heating roller on which the belt is wound and a fixing roller which nips the belt in cooperation with the pressure roller, in addition to the belt and the pressure roller, which are described above. The belt is wound on the heating and fixing rollers. The fixing unit typically includes the heating roller formed with bushes for stabilizing the belt tracking. The bushes held in contact with the lateral edges of the belt prevent the meander of the belt.

The meander of the belt (variation in tracking position of the belt in a lateral direction) adversely affects quality of a toner image to be fixed and conveyance of a sheet after a fixing process. A frame supporting the pressure roller and a frame supporting the heating and fixing rollers on which the belt is wound are typically separately provided. Errors in assembly between these frames and machining errors of both frames affect the meander of the belt. Accumulation of these error factors causes the meander of the belt which the aforementioned bushes may not overcome.

SUMMARY OF THE INVENTION

An object of the present invention is to provide a fixing unit and an image forming apparatus which include a structure for sufficiently decreasing meander of a belt.

One aspect according to the present invention is directed to a fixing unit for fixing a toner image formed on a sheet, including a belt unit including a belt configured to press the sheet; a reference roller configured to nip the sheet in cooperation with the belt; and a supporting element configured to support the belt unit and the reference roller; wherein: the belt unit includes first and second rollers on which the belt is wound; and the supporting element includes a supporting plate configured to support the first roller, the second roller and the reference roller.

Another aspect according to the present invention is directed to an image forming apparatus, including the aforementioned fixing unit.

These and other objects, features and advantages of the present invention will become more apparent upon reading the following detailed description along with the accompanying drawings.

DETAILED DESCRIPTION OF THE PREFERRED EMBODIMENTS

Hereinafter, a fixing unit and an image forming apparatus according to one embodiment are described with reference to the drawings. It should be noted that directional terms such as "upper", "lower", "left" and "right" used hereinafter are merely for clarifying the description and not of the nature to limit methodologies of the fixing unit and the image forming apparatus.

<Image Forming Apparatus>

Figure 1:
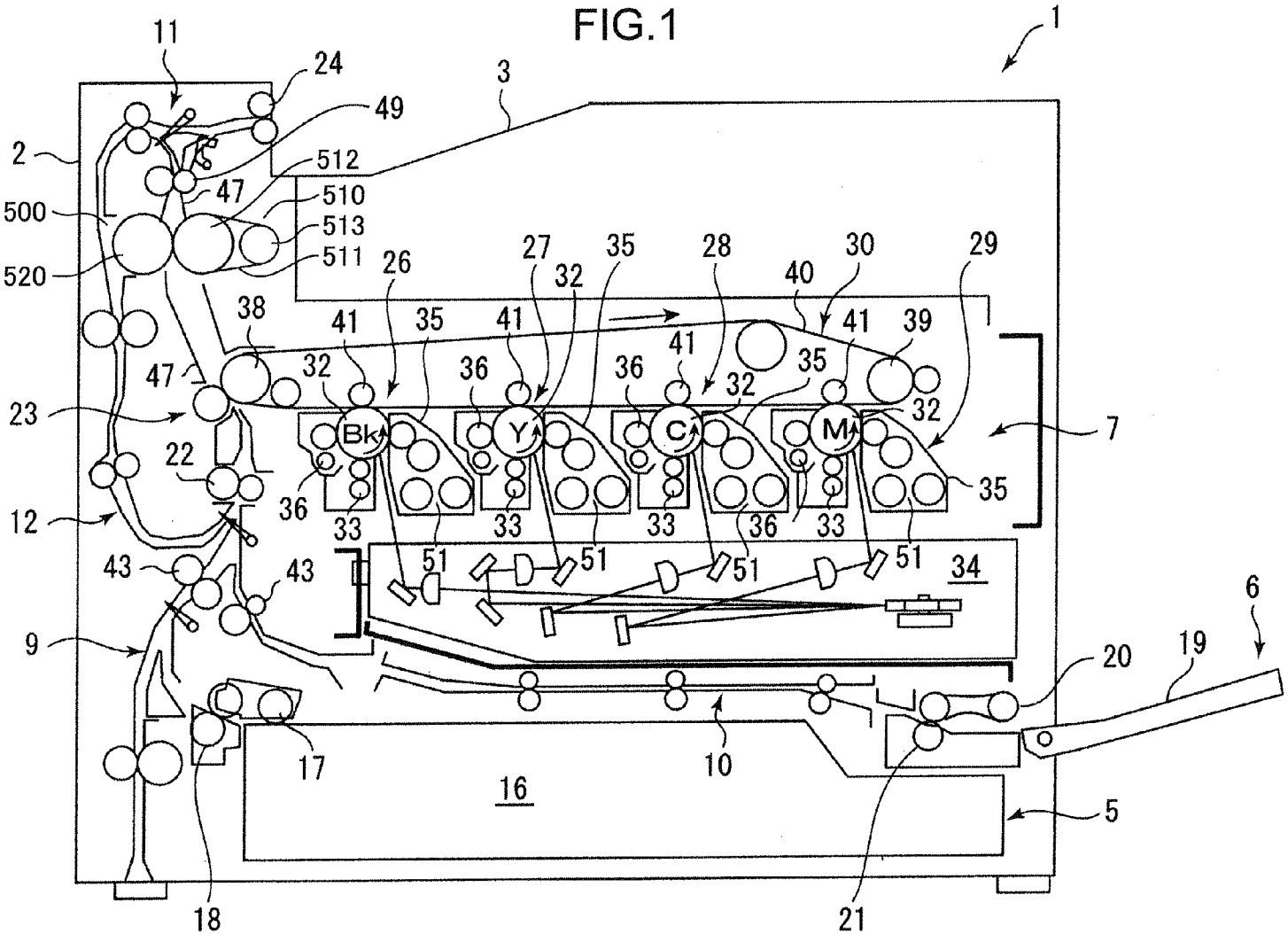
FIG. 1 is a diagram showing a schematic configuration of an image forming apparatus with a built-in fixing unit according to one embodiment.

FIG. 1 is a schematic diagram showing a configuration of the image forming apparatus with the fixing unit. The image forming apparatus shown in FIG. 1 is a tandem color printer. It should be noted that methodologies according to this embodiment may be applied to printers, copiers, facsimile machines, complex machines provided with these functions or other apparatuses for transferring and printing a toner image to and on a surface of a print medium such as a print sheet based on externally input image information.

The image forming apparatus 1 includes a rectangular-boxed housing 2. A color image is formed on a sheet in the housing 2. A discharge section 3 is provided at the upper surface of the housing 2. A sheet after color image printing thereon is discharged to the discharge section 3.

The housing 2 houses a sheet cassette 5, which feeds sheets, and an image forming station 7. Further, a stack tray 6 used to manually feed sheets is attached to the housing 2. The stack tray 6 is arranged above the sheet cassette 5. The image forming station 7 arranged above the stack tray 6 forms an image on a sheet based on image data such as characters and pictures externally transmitted to the image forming apparatus 1.

A first conveyance path 9 is formed in a left portion of the housing 2 shown in FIG. 1. A sheet fed from the sheet cassette 5 is conveyed to the image forming station 7 through the first conveyance path 9. A second conveyance path 10 is formed above the sheet cassette 5. A sheet fed from the stack tray 6 is conveyed from the right to the left of the housing 2 through the second conveyance path 10 to reach the image forming station 7. A fixing unit 500 configured to perform a fixing process on a sheet after an image forming process performed thereon by the image forming station 7 and a third conveyance path 11 for conveying the sheet after the fixing process to the discharge section 3 are provided in an upper left portion of the housing 2.

The sheet cassette 5 may be drawn to the outside (e.g. right side of FIG. 1) of the housing 2. A user may draw out the sheet cassette 5 to replenish the sheet cassette 5 with sheets. The sheet cassette 5 includes a storing portion 16. The user may selectively store various sheets in size in the storing portion 16. The sheets stored in the storing portion 16 are fed one by one to the first conveyance path 9 by feed and separation rollers 17, 18.

The stack tray 6 may be vertically rotatable between a closed position where it extends along the outer surface of the housing 2 and an open position (shown in FIG. 1) where it projects from the outer surface of the housing 2. Sheets may be placed on a manual feeding portion 19 of the stack tray 6 one by one. Alternatively, a user may place several sheets on the manual feeding portion 19. The sheets placed on the manual feeding portion 19 are fed one by one to the second conveyance path 10 by pickup and separation rollers 20, 21.

The first and second conveyance paths 9, 10 join before registration rollers 22. A sheet reached the registration rollers 22 is temporarily stopped by the registration rollers 22. The registration rollers 22, thereafter, perform skew and timing adjustments on the sheet. After the skew and timing adjustments, the registration rollers 22 feed the sheet toward a secondary transfer unit 23. A full color toner image on an intermediate transfer belt 40 is secondarily transferred to the sheet sent to the secondary transfer unit 23. After the secondary transfer, the sheet is fed to the fixing unit 500. The fixing unit 500 fixes the toner image to the sheet. Optionally, after the toner image is fixed on one side of the sheet, a new full color toner image may be formed on the other side of the sheet in the secondary transfer unit 23 (duplex printing). In the case of the duplex printing, after the toner image is fixed to one side of the sheet, the sheet is conveyed to a fourth conveyance path 12, so that the sheet becomes reversed. The new toner image formed on the other side of the sheet in the secondary transfer unit 23 is fixed by the fixing unit 500. Thereafter, the sheet is conveyed along the third conveyance path 11 and discharged to the discharge section 3 by discharge rollers 24.

The image forming station 7 includes four image forming units 26 to 29 configured to form toner images of black (Bk), yellow (Y), cyan (C) and magenta (M), respectively. The image forming station 7 further includes an intermediate transfer unit 30. The intermediate transfer unit 30 carries toner images formed and superimposed by these image forming units 26 to 29.

Each of the image forming units 26 to 29 includes a photoconductive drum 32 and a charger 33 arranged to face the circumferential surface of the photoconductive drum 32. The image forming units 26 to 29 includes a laser scanning unit 34 configured to emit laser beams to the circumferential surfaces of the photoconductive drums 32 in accordance with image data such as characters and pictures externally transmitted to the image forming apparatus 1. The laser beams from the laser scanning unit 34 irradiate the circumferential surfaces of the photoconductive drums 32 at downstream positions of the chargers 33. Each of the image forming units 26 to 29 further includes a developing unit 35 arranged to face the circumferential surface of the photoconductive drum 32. The developing unit 35 supplies toner to the circumferential surface of the photoconductive drum 32 bearing an electrostatic latent image formed by irradiation of the laser beam to form a toner image. The toner image formed on the circumferential surface of the photoconductive drum 32 is transferred to the intermediate transfer unit 30 (primary transfer). Each of the image forming units 26 to 29 further includes a cleaner 36 arranged to face the circumferential surface of the photoconductive drum 32. The cleaner 36 cleans the circumferential surface of the photoconductive drum 32 after the primary transfer.

The photoconductive drums 32 of the image forming units 26 to 29 shown in FIG. 1 are counterclockwise rotated by drive motors (not shown), respectively. Black toner, yellow toner, cyan toner and magenta toner are stored in toner boxes 51 of the developing units 35 of the image forming units 26 to 29, respectively.

The intermediate transfer unit 30 includes a rear roller (drive roller) 38 arranged near the image forming unit 26, a front roller (idler) 39 arranged near the image forming unit 29, and the intermediate transfer belt 40 extending between the rear and front rollers 38, 39. The intermediate transfer unit 30 further includes four transfer rollers which press the intermediate transfer belt 40 against the photoconductive drums 32 of the image forming units 26 to 29, respectively. The transfer rollers 41 press the intermediate transfer belt 40 against the circumferential surfaces of the photoconductive drums 32 bearing toner images formed by the developing units 35 to execute the transfer (primary transfer) of the toner images to the intermediate transfer belt 40.

As a result of the transfer of the toner images to the intermediate transfer belt 40, the toner images formed by the black toner, the yellow toner, the cyan toner and the magenta toner are superimposed on the intermediate transfer belt 40 to form a full color toner image.

The first conveyance path 9 extends toward the intermediate transfer unit 30. A sheet fed from the sheet cassette 5 reaches the intermediate transfer unit 30 through the first conveyance path 9. Several conveyor rollers 43 are appropriately arranged along the first conveyance path 9 to convey a sheet. The registration rollers 22 before the intermediate transfer unit 30 adjust a feed timing of the sheet passing in the first conveyance path 9 in synchronization with the image forming operation of the image forming station 7.

The fixing unit 500 heats and presses the sheet. As a result, the unfixed toner image on the sheet immediately after the secondary transfer is fixed. The fixing unit 500 includes a belt unit 510 with a belt 511 configured to press the sheet, and a reference roller 520 configured to nip the sheet in cooperation with the belt 511. The belt unit 510 includes first and second rollers 512, 513 on which the belt 511 is wound.

Conveyor rollers 49 are arranged after the fixing unit 500. A conveyance path 47 extending from the secondary transfer unit 23 toward the conveyor rollers 49 is formed in the housing 2. The sheet conveyed through the intermediate transfer unit 30 is introduced to a nip portion between the reference roller 520 and the belt 511 through the conveyance path 47. The toner image is fixed to the sheet in the nip portion. The sheet after passing in between the reference roller 520 and the belt 511 is, then, guided to the third conveyance path 11 via the conveyance path 47.

The conveyor rollers 49 feed the sheet to the third conveyance path 11. The third conveyance path 11 guides the sheet after the fixing process thereon by the fixing unit 500 to the discharge section 3. The discharge rollers 24 at the exit of the third conveyance path 11 discharge the sheet to the discharge section 3.

<Fixing Unit>

Figure 2:
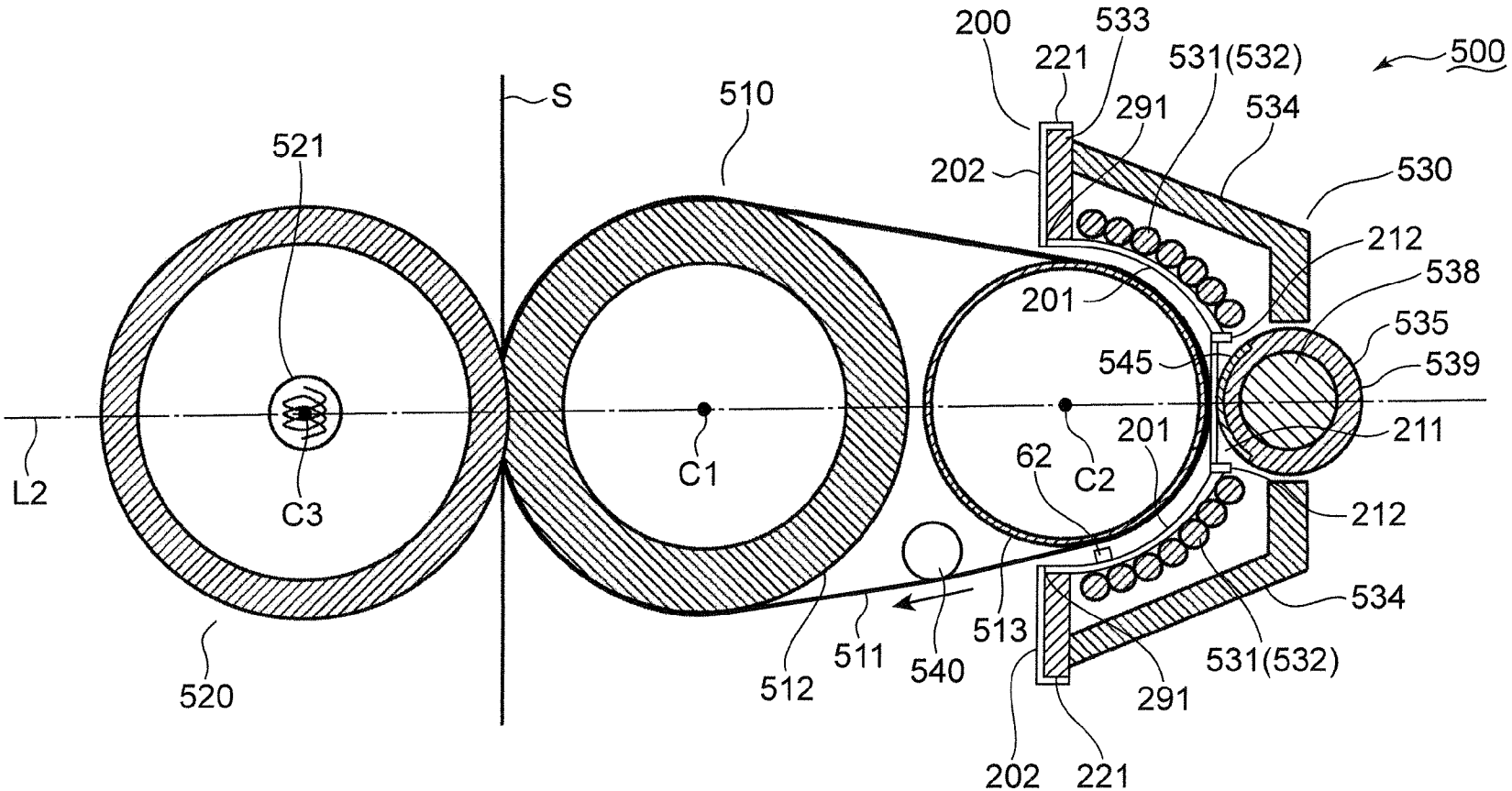
FIG. 2 is a schematic sectional view of the fixing unit provided in the image forming apparatus shown in FIG. 1.

FIG. 2 is a schematic sectional view of the fixing unit 500. The fixing unit 500 is described with reference to FIGS. 1 and 2.

The fixing unit 500 includes an IH coil unit 530 configured to heat the belt 511 and the second roller 513, in addition to the belt unit 510 and reference roller 520, which are described above. It should be noted that an element other than the IH coil unit 530 may be used as a heat source for fixing a toner image to a sheet S. For example, an electric heating element arranged in the first roller 512 may be used as a heat source. In this embodiment, a halogen heater 521 arranged in the reference roller 520 is used as a heat source in addition to the IH coil unit 530.

The IH coil unit 530 includes a coil 531 for induction-heating the belt 511 and the second roller 513, and a platform 200 configured to support the coil 531. The IH coil unit 530 further includes side cores 533, arch cores 534 and a center core 535 which define paths of magnetic lines in a magnetic field generated by the coil 531. The side cores 533, the arch cores 534 and the center core 535 are supported by the platform 200.

(IH Coil Unit)

Figure 3C:
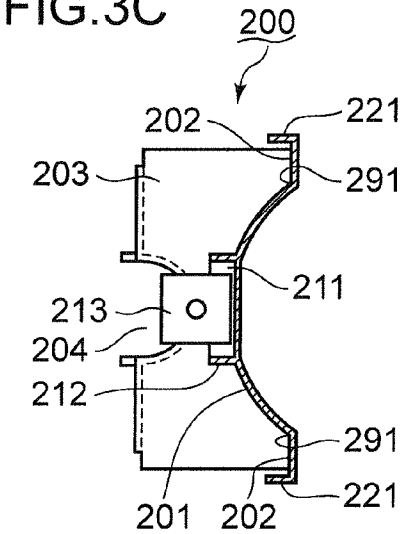
FIG. 3C is a sectional view schematically showing the platform provided in the fixing unit shown in FIG. 2.
Figure 3A:
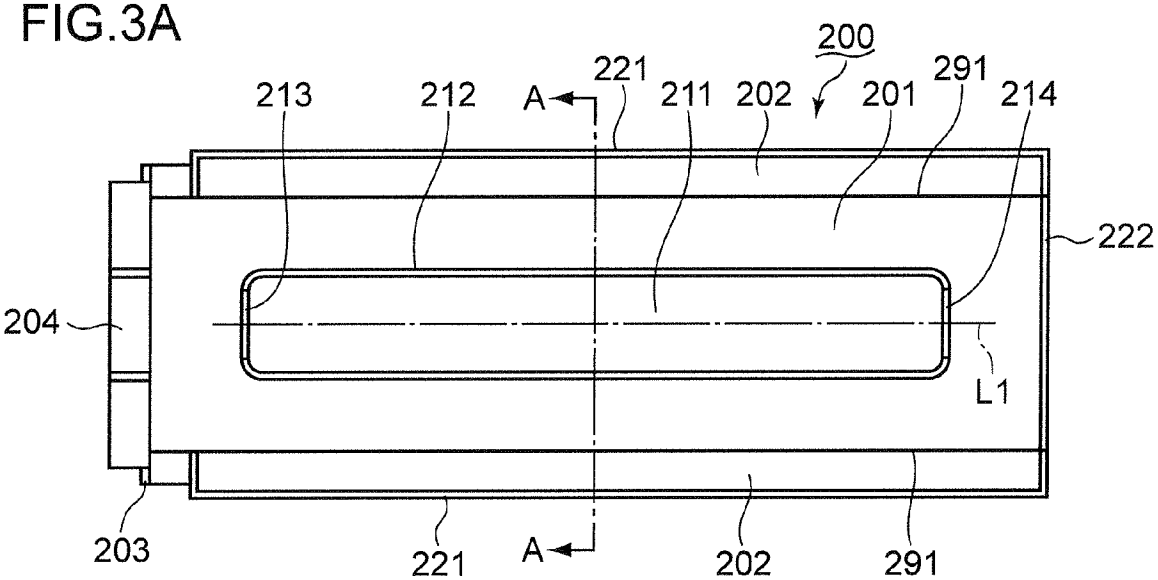
FIG. 3A is a plan view schematically showing a platform provided in the fixing unit shown in FIG. 2.
Figure 3B:
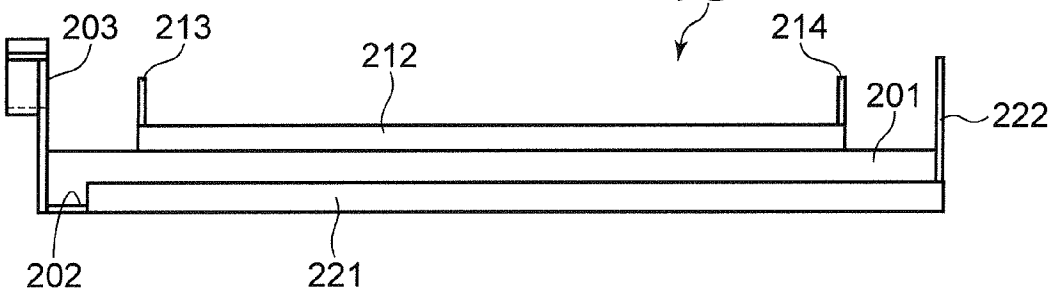
FIG. 3B is a side view schematically showing the platform provided in the fixing unit shown in FIG. 2.

FIGS. 3A to 3C schematically show the platform 200. FIG. 3A is a schematic plan view of the platform 200 depicted from a coil supporting surface on which the coil 531 is supported. FIG. 3B is a side view of the platform 200. FIG. 3C is a sectional view of the platform 200 along a line A-A shown in FIG. 3A. The IH coil unit 530 is described with reference to FIGS. 2 and 3A to 3C.

The platform 200 includes a substantially rectangular coil supporting portion 201 (see FIG. 3A). The coil supporting portion 201 supports the coil 531, which causes a magnetic field for induction-heating the belt 511 and the second roller 513. The coil supporting portion 201 includes a curved surface (see FIG. 3C) extending along the circumferential surface of the second roller 513. The coil supporting portion 201 includes positioning walls 212 extending along a longitudinal axis L1 of the platform 200. The positioning walls 212 projecting toward the center core 535 define the inner edge of a coil surface 532 formed by the coil 531 wound on the coil supporting portion 201. The positioning walls 212 held in contact with the coil 531 forming the coil surface 532 is used to position the coil surface 532.

The platform 200 includes a first upright wall 213 which defines a substantially rectangular area 211 in the center in cooperation with the positioning walls 212 and a second upright wall 214 facing the first upright wall 213. The first and second upright walls 213, 214 aligned in the longitudinal axis L1 of the platform 200 define the inner edge of the coil surface 532 in cooperation with the positioning walls 212. The center core 535 is mounted on the first and second upright walls 213, 214 projecting toward the center core 535 more than the positioning walls 212. Thus, the center core 535 lies along the area 211.

The platform 200 includes core supporting portions 202 next to the outer edges 291 of the coil supporting portion 201 parallel to the longitudinal axis L1 of the area 211. The side cores 533 are fixed to flat surfaces of the core supporting portions 202. The platform 200 includes positioning walls 221 formed along the outer edges of the core supporting portions 202. The positioning walls 221 projecting from the core supporting portions 202 work for positioning the side cores 533 on the core supporting portions 202. The positioning walls 221 form a rectangular area surrounding the core supporting portions 202.

The platform 200 includes a third upright wall 222 facing the second upright wall 214. The coil supporting portion 201 extends in between the second and third upright walls 214, 222. The second upright wall 214 is adjacent to the inner edge of the coil surface 532 formed on the coil supporting portion 201 whereas the third upright wall 222 is adjacent to the outer edge of the coil surface 532 formed on the coil supporting portion 201.

The platform 200 includes a fourth upright wall 203 adjacent to an end of the coil supporting portion 201, which is opposite to the other end where the third upright wall 222 is formed. The fourth upright wall 203 is formed with a substantially U-shaped notch 204. A power line (not shown) extends to the coil 531 on the coil supporting portion 201 through the notch 204 of the fourth upright wall 203. Power used to generate a magnetic field is supplied to the coil 531 through the power line. The platform 200 is integrally formed of a nonconductive heat resistant material (e.g. PPS, PET, LCP). A dimension of the inner diameter of the coil surface 532 formed on the platform 200 along a major axis may be, for example, about 360 mm. Further, a distance between the first and second upright walls 213, 214 may be, for example, about 350 mm. A longitudinal dimension of the center core 535 may be, for example, about 340 mm.

Figure 4:
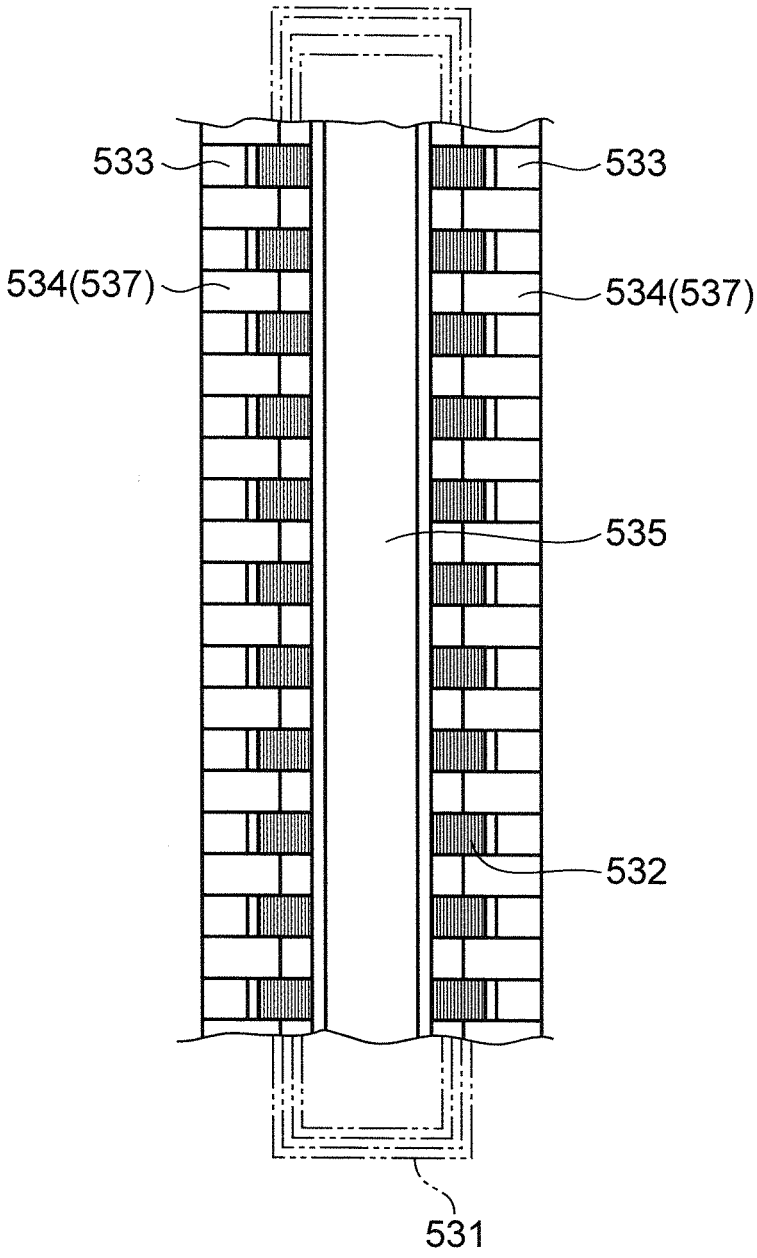
FIG. 4 is a schematic view of an IH coil unit provided in the fixing unit shown in FIG. 2.

FIG. 4 schematically shows the coil 531, the side cores 533, the arch cores 534 and the center core 535, which are placed on the platform 200. The IH coil unit 530 is further described with reference to FIGS. 2 and 4.

The IH coil unit 530 surrounding the belt 511 on the second roller 513 includes the paired side cores 533 and the paired arch cores 534, which are symmetrically arranged with respect to a straight line L2 connecting the rotation axes C1, C2, C3 of the first roller 512, the second roller 513 and the reference roller 520. The coil 531 forms the looped coil surface 532 in a space surrounded by the coil supporting portion 201 of the platform 200, the side cores 533 and the arch cores 534. The center core 535 is arranged between the paired arch cores 534, which are mounted on the paired side cores 533, respectively.

The coil 531 arranged on the coil supporting portion 201 of the platform 200 is formed by twisting several enameled wires insulated from each other. As power is supplied to the coil 531, the coil 531 generates a magnetic field/magnetic flux for induction-heating the belt 511 on the second roller 513.

As described above, the coil supporting portion 201 is formed along the arcuate outer surface of the belt 511 on the second roller 513. The coil 531 is arranged to surround the coil supporting portion 201. As a result, the coil 531 is sequentially arranged along the curved coil supporting portion 201 to form the looped coil surface 532, which has a substantially arcuate cross section. A substantially half of the second roller 513 shown in FIG. 2 is surrounded by the coil 531.

The center core 535 located on the straight line L2 connecting the rotation axes C1, C2, C3 of the first roller 512, the second roller 513 and the reference roller 520 is arranged near the second roller 513. The center core 535 is arranged along the area 211 of the platform 200.

The paired arch cores 534 are symmetrically arranged with respect to the center core 535. Similarly, the paired side cores 533 are symmetrically arranged with respect to the center core 535. The arch cores 534 are made of ferrite and formed to have an arched cross section. The arch cores 534 are longer than the coil surface 532. The side cores 533 are made of ferrite and molded in a block shape. The arch cores 534 and the side cores 533 partially surround the outer side of the coil surface 532. The coil surface 532 is surrounded by the outer surface of the belt 511, the side cores 533, the arch cores 534 and the center core 535.

Each arch core 534 includes, for example, arch core pieces 537 at several positions at intervals, which are aligned in the longitudinal direction of the center core 535. The arch core pieces 537 may be substantially L-shaped ferrite members of about 10 mm in width. A denser arrangement of the arch core pieces 537 increases heating efficiency. On the other hand, a coarser arrangement of the arch core pieces 537 contributes to a reduction in manufacturing cost and weight saving of the fixing unit 500. Accordingly, it is preferable that the arrangement density of the arch core pieces 537 is appropriately determined on the basis of the heating efficiency, manufacturing cost and/or weight saving. The arch core pieces 537 shown in FIG. 4 are aligned at equal intervals. Alternatively, the arrangement of the arch core pieces 537 may become coarser near the longitudinal center position of the center core 535 whereas it may become denser near the ends of the center core 535. Clearances between the arch core pieces 537 may be determined, for example, in the range from ⅓ to ½ of the width of the arch core pieces 537.

As described above, the side cores 533 are arranged on the core supporting portions 202 of the platform 200. Each side core 533 may be formed of successively arranged ferrite plates from 30 mm to 60 mm in length. The arrangements of the arch cores 534 and the side cores 533 may be determined, for example, in accordance with a magnetic flux density (field intensity) distribution of the magnetic field generated from the coil 531. In parts free from the arch core pieces 537, the side cores 533 compensate for focusing effect of the magnetic field to make the magnetic flux density distribution (temperature difference) uniform in the longitudinal direction (direction along the longitudinal axis L1 shown in FIGS. 3A to 3C). The arch cores 534 and the side cores 533 at least partially surround the second roller 513, the belt 511 and the coil surface 532 in cooperation with a magnetic tube (to be described later) of the center core 535.

Figure 5:
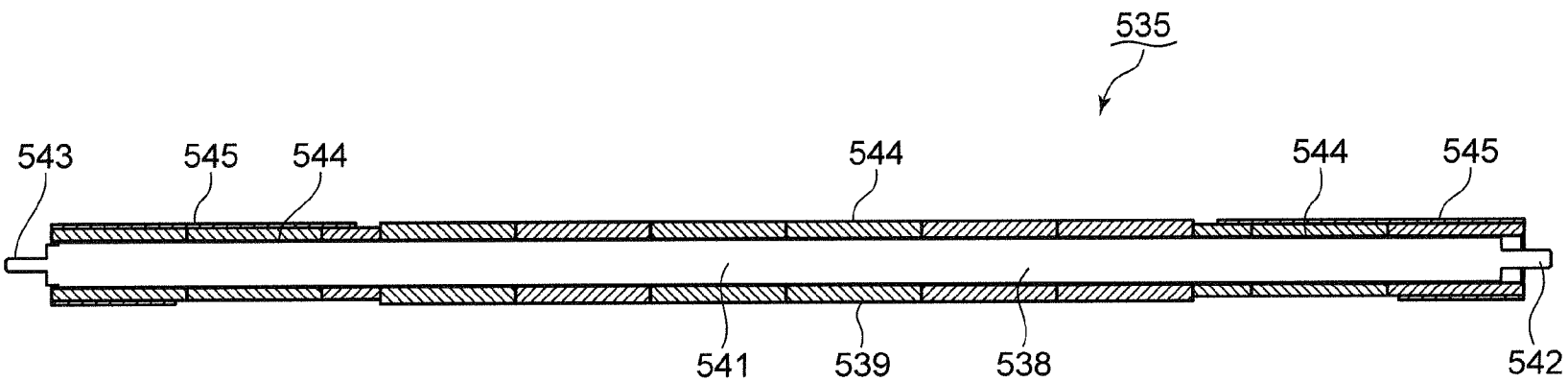
FIG. 5 is a schematic sectional view of a center core of the IH coil unit shown in FIG. 4.

FIG. 5 is a longitudinal sectional view of the center core 535. The IH coil unit 530 is further described with reference to FIGS. 2, 3A to 3C and 5.

The center core 535 includes a cylindrical conductive shaft 538 and a cylindrical magnetic tube 539 covering the conductive shaft 538. The magnetic tube 539 is bonded to the conductive shaft 538, for example, using silicon adhesive. The cylindrical magnetic tube 539 is, for example, 14 mm to 20 mm in outer diameter. The conductive shaft 538 includes a trunk 541 configured to fit into the cylindrical magnetic tube 539 and a pair of journals 542, 543. The journal 542 is arranged at the drive side of the IH coil unit 530. The journal 543 is supported and driven on the first upright wall 213 to rotate. The journals 542, 543 are thinner than the trunk 541. The journals 542, 543 coaxial with the trunk 541 project outwardly from the magnetic tube 539. The conductive shaft 538 is preferably made of nonmagnetic stainless steel. The conductive shaft 538 made of stainless steel results in less deformation of the center core 535.

The magnetic tube 539 includes substantially cylindrical magnetic tube pieces 544. The magnetic tube pieces 544 are formed of, e.g. ferrite. The several magnetic tube pieces 544 are connected along the conductive shaft 538. The magnetic tube pieces 544 arranged at longitudinal central positions of the conductive shaft 538 is larger in outer diameter than the magnetic tube pieces 544 located at the left and right ends of the trunk 541 of the conductive shaft 538. Magnetic shielding plates 545 partially cover the outer circumferential surfaces of the smaller magnetic tube pieces 544 in diameter to fill steps between the magnetic tube pieces 544 located at the center of the conductive shaft 538 and those located at the left and right ends of the conductive shaft 538.

The magnetic shielding plates 545 are preferably made of a nonmagnetic material with good conductivity (e.g. oxygen-free copper). Penetration of a magnetic field perpendicular to the surfaces of the magnetic shielding plates 545 causes an induction current. This induction current results in a reverse magnetic field to cancel an interlinkage flux (perpendicular penetrating magnetic field). As a result, the magnetic shielding plates 545 may shield the magnetic field. The magnetic shielding plates 544 made of the well-conductive material may also suppress generation of Joule heat resulting from the induction current, so that the magnetic shielding plates efficiently shield the magnetic field. The magnetic shielding plates 545 made of a material having a small specific resistance and/or the thick magnetic shielding plates 545 have high conductivity. The magnetic shielding plates 545 is preferably 0.5 mm or larger in thickness. The magnetic shielding plates 545 of about 1 mm in thickness are used in this embodiment.

Figure 6:
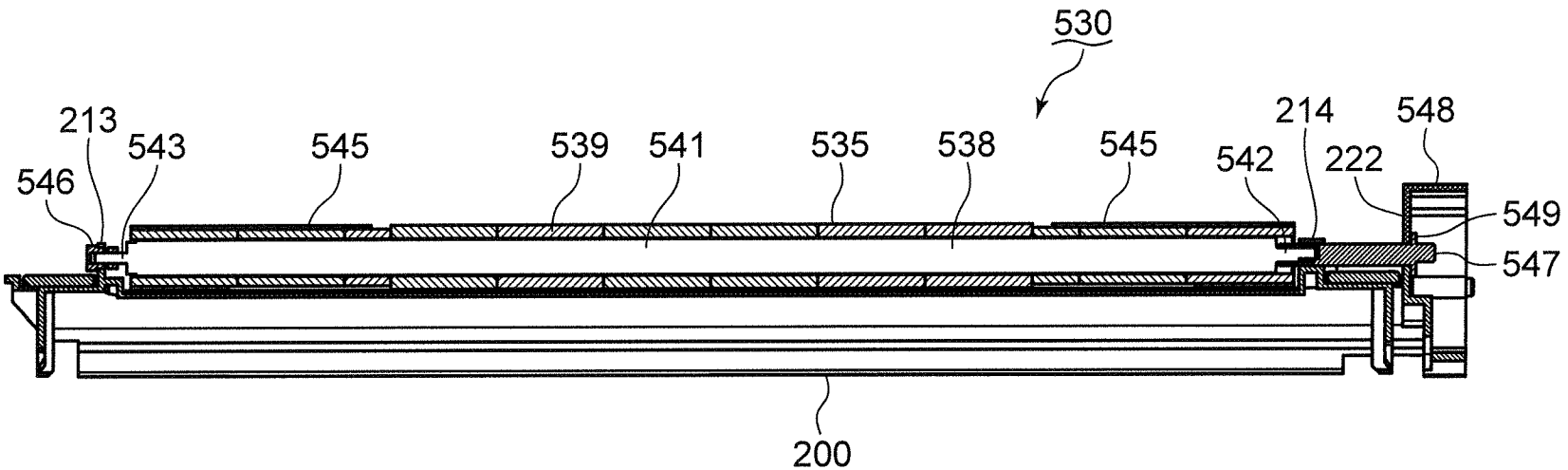
FIG. 6 is a schematic sectional view of the IH coil unit shown in FIG. 4.

FIG. 6 is a schematic sectional view of the IH coil unit 530. The IH coil unit 530 is further described with reference to FIGS. 2, 3A to 3C, 5 and 6.

As described above, the journal 543 of the center core 535 is supported on the first upright wall 213 of the platform 200. A tip of the journal 543 is covered with a nonconductive cap 546. It is likely that the cap 546 suitably prevents a current supplied to the coil surface 532 from transmitting to the conductive shaft 538.

The journal 542 of the center core 535 is supported on the second upright wall 214 of the platform 200. The journal 542 inserted into a through hole formed in the second upright wall 214 is coupled to a nonconductive bridge 547 in the second upright wall 214. The substantially cylindrical bridge 547 extends between the second and third upright walls 214, 222. It is likely that the bridge 547 suitably prevents the current supplied to the coil surface 532 from transmitting to the conductive shaft 538.

A housing 548 is formed beside the third upright wall 222. A tip of the bridge 547 is housed in the housing 548. A gear 549 is formed on the tip of the bridge 547. A gear structure (not shown) for transmitting a drive force toward the gear 549 to rotate the center core 535 is formed in the housing 548. The drive force transmitted to the gear 549 is further transmitted to the journal 542 engaged with a base end of the bridge 547 in the second upright wall 214. As a result, the conductive shaft 538, the magnetic tube 539 covering the trunk 541 of the conductive shaft 538 and the magnetic shielding plates 545 mounted on the magnetic tube 539 integrally rotate.

Figure 7:
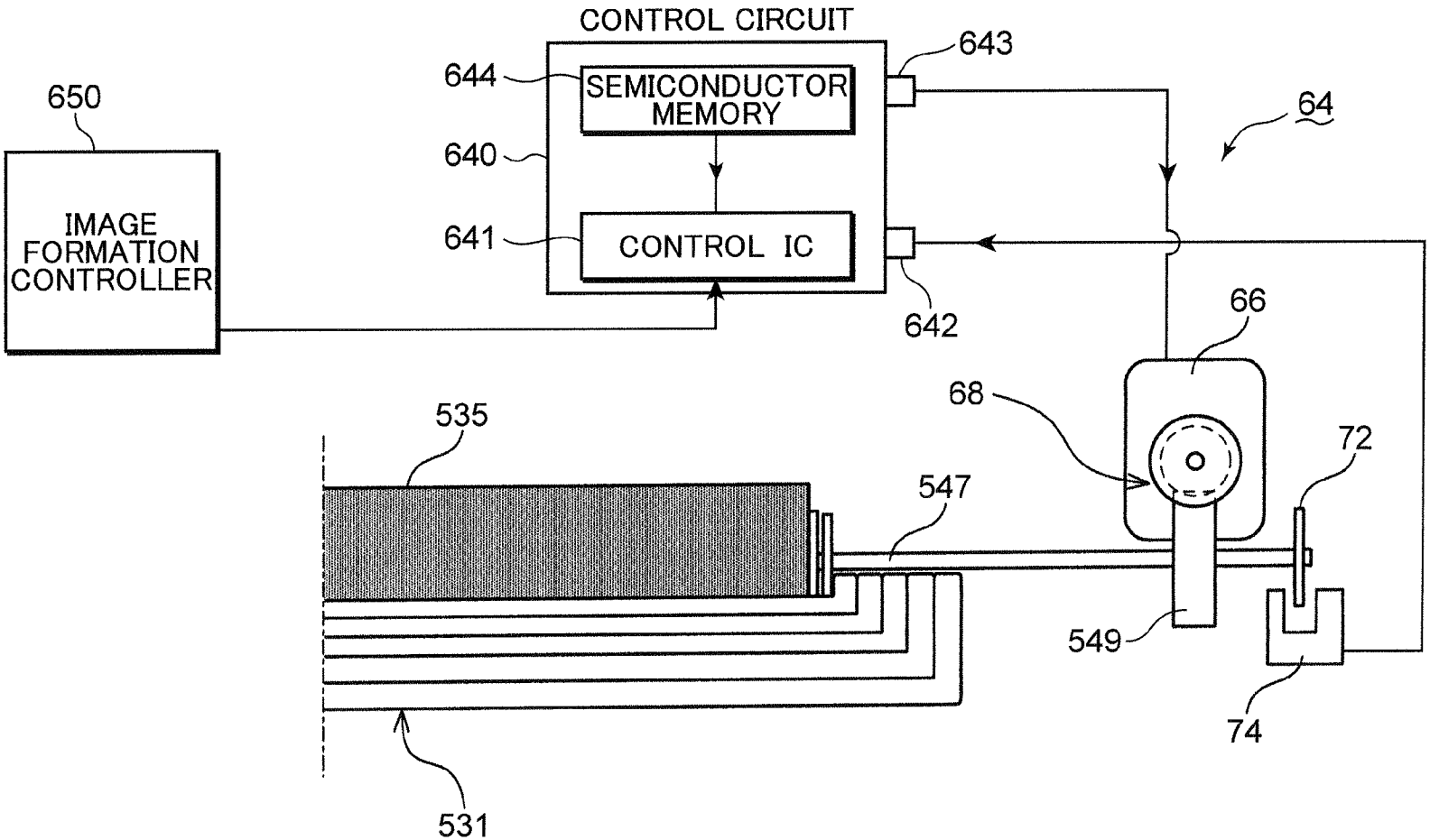
FIG. 7 is a schematic block diagram of a driving mechanism for the center core shown in FIG. 5.

FIG. 7 shows the configuration of a driving mechanism connected to the center core 535. The driving mechanism configured to rotate the center core 535 is described with reference to FIGS. 1, 6 and 7.

The driving mechanism 64 may be, for example, built in the housing 548 of the platform 200 shown in FIG. 6. The driving mechanism 64 rotates the center core 535 via the bridge 547. The positions of the magnetic shielding plates 545 are changed by the rotation of the center core 535. As the magnetic shielding plates 545 move, a magnetic field generated by the power supply to the coil 531 or paths of magnetic lines are switched.

The driving mechanism 64 includes, for example, a stepping motor 66 arranged in the housing 548 and a decelerator 68 configured to decelerate the rotation of the stepping motor 66. The gear 549 of the bridge 547 engaged with the journal 542 of the center core 535 is also engaged with the decelerator 68. The stepping motor 66 rotates the center core 535 by driving the bridge 547. A worm gear may be, for example, used as the decelerator 68. The driving mechanism 64 further includes a slit disc 72 fixed to an end of the bridge 547 and a photo-interrupter 74 which detects a rotation angle of the slit disc 72 (i.e. rotation angle of the center core 535 (angular displacement amount from a reference position)).

The rotation angle of the center core 535 is controlled, for example, by the number of drive pulses applied to the stepping motor 66. The driving mechanism 64 includes a control circuit 640 configured to control the rotation of the stepping motor 66. The control circuit 640 includes, for example, a control IC 641, an input driver 642, an output driver 643 and a semiconductor memory 644. A detection signal from the photo-interrupter 74 is input to the control IC 641 via the input driver 642. The control IC 641 detects the present rotation angle (position) of the center core 535 based on the input signal. Meanwhile an information signal on the present sheet size is sent from an image formation controller 650 of the image forming apparatus 1 shown in FIG. 1 to the control IC 641. After receiving the information signal from the image formation controller 650, the control IC 641 reads information on a rotation angle suitable for the sheet size from the semiconductor memory (ROM) 644 and outputs drive pulses necessary to reach a target rotation angle in a predetermined cycle. The drive pulses are applied to the stepping motor 66 via the output driver 643. The stepping motor 66 operates in accordance with the drive pulses. It should be noted that if only the reference position needs to be detected upon controlling the stepping motor 66, the slit disc 72 may be used as an index member. At the reference position, the index member may be detected by the photo-interrupter 74.

(Belt Unit and Reference Roller)

The belt unit 510 and the reference roller 520 are described again with reference to FIG. 2.

The belt unit 510 includes the first roller 512, the second roller 513 between the IH coil unit 530 and the first roller 512, and the belt 511 wound on the first and second rollers 512, 513. The reference roller 520 nips the belt 511 in cooperation with the first roller 512. A flat nip is formed between the reference roller 520 and the belt 511.

The belt 511 includes, for example, a nickel electroformed substrate from 30 μm to 50 μm in thickness, a silicon rubber layer laminated on the nickel electroformed substrate and a release layer (e.g. PFA layer) formed on the silicon rubber layer. The cylindrical second roller 513 may be, for example, 30 mm in outer diameter. The second roller 513 includes a cylindrical iron core and a release layer (e.g. PFA layer) from 0.2 mm to 1.0 mm in thickness which is formed on the outer circumferential surface of the iron core. The first roller 512 is, for example, cylindrical. The first roller 512 includes a core roller made of stainless steel which is 45 mm in outer diameter and a sponge layer made of silicon rubber from 5 mm to 10 mm in thickness which covers the outer circumferential surface of the core roller. The cylindrical reference roller 520 is, for example, 50 mm in outer diameter. The reference roller 520 includes a core roller made of stainless steel, a sponge layer made of silicon rubber from 2 mm to 5 mm in thickness which covers the outer circumferential surface of the core roller and a release layer (e.g. PFA layer). A metallic core material of the reference roller 520 may be formed, for example, using Fe or Al. A Si rubber layer may be formed on this core material. Further, a fluororesin layer may be formed on the outer surface of the Si rubber layer.

The fixing unit 500 further includes a tension roller 540 which applies tension to the belt 511. The tension roller 540 partially comes into contact with the inner surface of the belt 511 moving from the second roller 513 to the first roller 512. It is likely that the tension roller 540 prevents the traveling belt 511 from sagging to stabilize the tracking of the belt 511.

The fixing unit 500 includes a thermistor 62 configured to measure a temperature of the belt 511 in a non-contact manner. The thermistor 62 is preferably arranged at an outer side of the belt 511 where a large quantity of heat is generated by induction heating. It should be noted that the temperature of the belt 511 may be measured using a thermostat instead of the thermistor. Alternatively, the thermistor 62 or thermostat may be arranged in the second roller 513. The arrangement of a temperature measuring element such as a thermistor or thermostat contributes to an improvement in safety at the time of an abnormal temperature rise.

(Heat Quantity Control for Belt Unit)

Figure 8A:
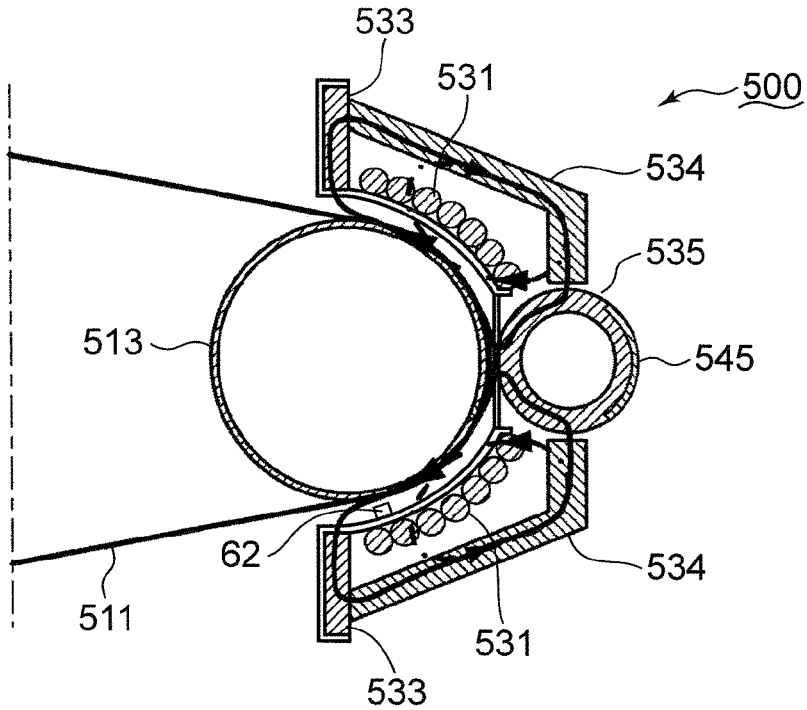
FIG. 8A is a schematic view of temperature control by the rotation of the center core shown in FIG. 4.
Figure 8B:
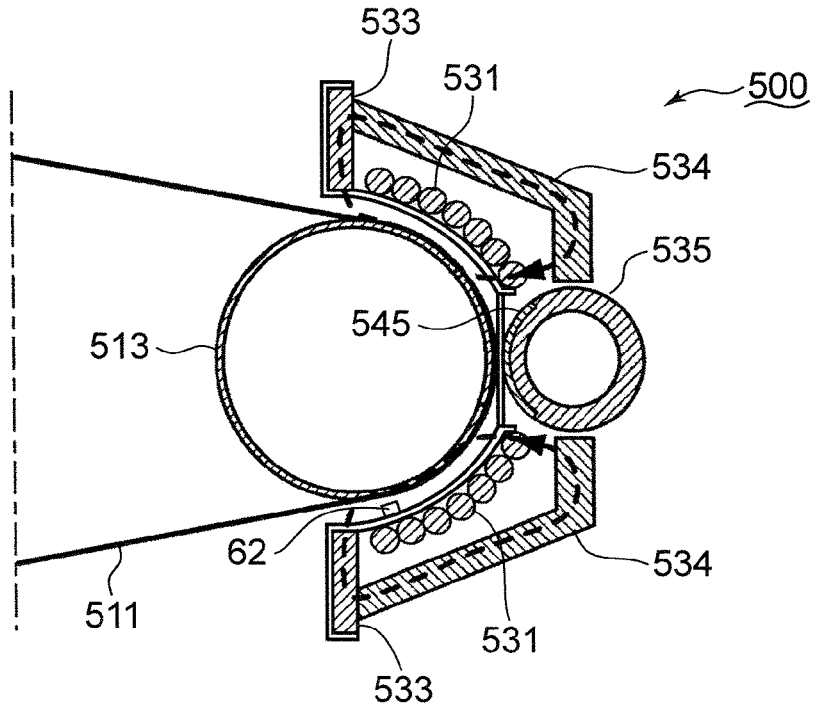
FIG. 8B is a schematic view of the temperature control by the rotation of the center core shown in FIG. 4.

FIGS. 8A and 8B schematically show a heat quantity control for the belt unit 510. FIG. 8A is a sectional view schematically showing the fixing unit 500 in which the magnetic shielding plates 545 are deployed at a retracted position where the magnetic shielding plates 545 is the most distant from the second roller 513. FIG. 8B is a sectional view schematically showing the fixing unit 500 in which the magnetic shielding plates 545 are arranged at a proximate position where the magnetic shielding plates 545 is the most proximate to the second roller 513. The heat quantity control for the belt unit 510 is described with reference to FIGS. 2, 7 to 8B.

The rotation of the center core 535 by the driving mechanism 64 is used for the heat quantity control for the belt unit 510. A fixing process for a large sheet requires the heat supply over a wider range. On the other hand, a fixing process for a small sheet requires the heat supply over a narrower range. When a large sheet passes through the fixing unit 500, the driving mechanism 64 rotates the center core 535 so that the magnetic shielding plates 545 reach the retracted position. When a small sheet passes through the fixing unit 500, the driving mechanism 64 rotates the center core 535 so that the magnetic shielding plates 545 reach the proximate position.

If the magnetic shielding plates 545 are at the retracted position, the magnetic lines of the magnetic field generated by the coil 531 pass through the second roller 513 and the belt 511 via first paths P1 (thick solid line in FIG. 8A) passing through the side cores 533, the arch cores 534 and the center core 535. As a result, an eddy current is generated in the ferromagnetic belt 511 and the second roller 513. The eddy current generates Joule heats corresponding to specific resistances of the respective materials. Thus, the belt 511 and the second roller 513 are entirely heated without interference of the magnetic shielding plates 545.

The magnetic shielding plates 545 at the proximate position are located on the first paths shown in solid line in FIG. 8A. The magnetic shielding plates 545 forms a shielding surface, which prevents the magnetic field from passing through, on the paths toward the belt 511 and the second roller 513 via the center core 535, so that the paths of the magnetic lines are switched to second paths (thick broken line in FIG. 8B) which do not pass through the center core 535. As a result, the amount of heat generation goes down in areas of the belt 511 and the second roller 513 that face both ends of the center core where the magnetic shielding plates 545 are arranged.

(Roller Unit)

Figure 9:
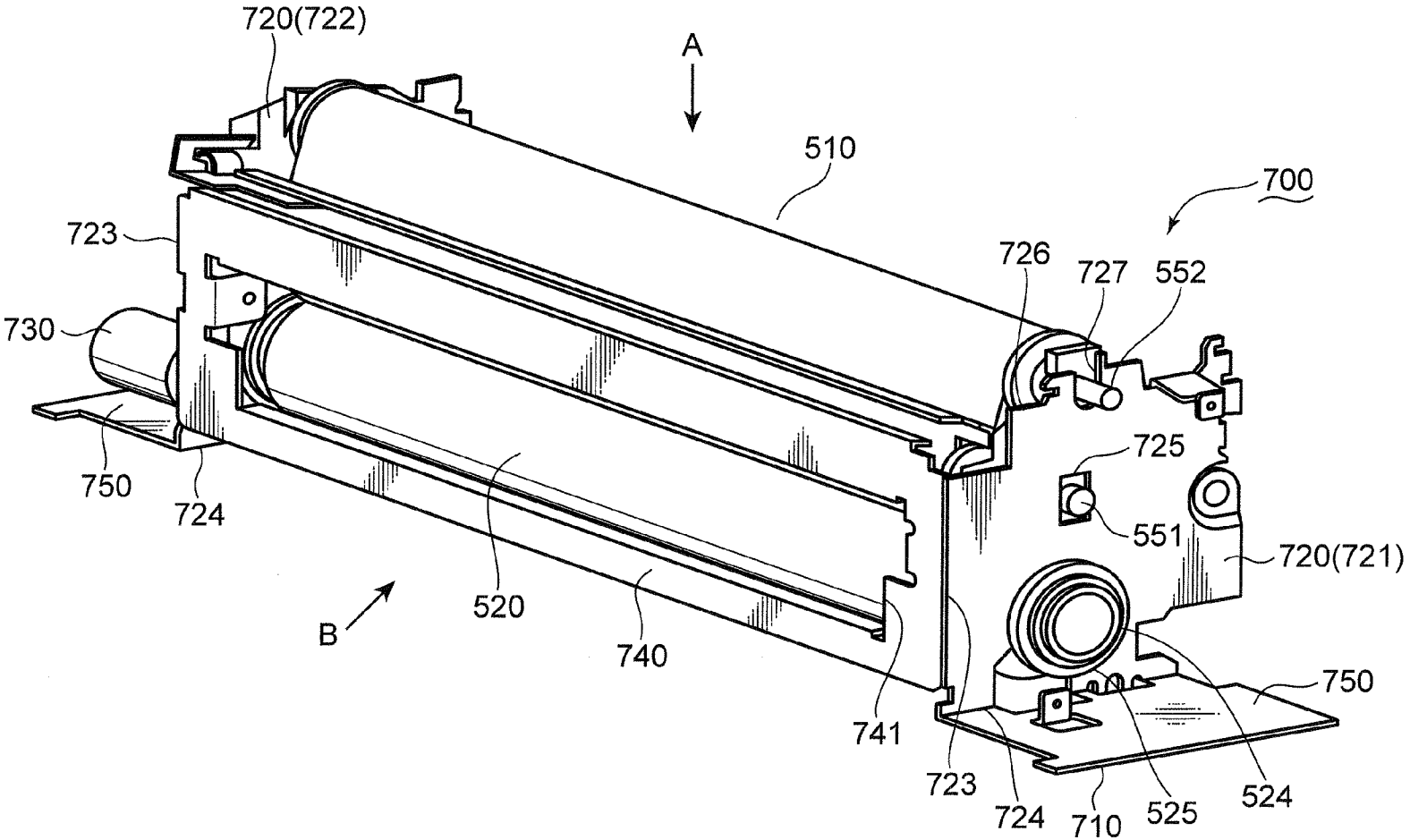
FIG. 9 is a schematic perspective view of a roller unit provided in the fixing unit shown in FIG. 2.

FIG. 9 is a perspective view of a roller unit 700 including the belt unit 510 and the reference roller 520. The roller unit 700 is described with reference to FIGS. 1, 2, 6 and 9.

The IH coil unit 530 and the roller unit 700 may be separately mounted in the housing 2 of the image forming apparatus 1, respectively. It is preferable that relative position between the IH coil unit 530 and the roller unit 700 in the housing 2 (e.g. distance between the rotation axes of the center core 535 and the reference roller 520) are more carefully adjusted.

The roller unit 700 includes a supporting frame 710, which supports the belt unit 510 and the reference roller 520. In this embodiment, the supporting frame 710 is exemplified as a supporting element configured to support the belt unit 510 and the reference roller 520.

The supporting frame 710 includes supporting plates 720, which support the first roller 512, the second roller 513 and the reference roller 520. The supporting plates 720 include a first supporting plate 721 and a second supporting plate 722 facing the first supporting plate 721. A motor 730 configured to drive the reference roller 520 is arranged on the outer surface of the second supporting plate 722. A gear structure (not shown) configured to transmit a drive force from the motor 730 to the reference roller 520 and the belt unit 510 may be built on the outer surface of the second supporting plate 722.

The supporting frame 710 includes a frame plate 740 between the first and second supporting plates 721, 722. A substantially rectangular passage opening 741 is formed in the center of the frame plate 740. A sheet S after passing through a nip portion between the belt unit 510 and the reference roller 520 is discharged from the fixing unit 500 through the passage opening 741.

The supporting frame 710 is preferably formed of one metal plate. Substantially straight bent portions 723, which define a boundary between the first supporting plate 721 and the frame plate 740 and a boundary between the second supporting plate 722 and the frame plate 740, respectively, are formed by performing a bending process on the metal plate.

The supporting frame 710 includes base plates 750 extending from edges of the supporting plates 720. The base plates 750 are, for example, used for connection with the housing 2 of the image forming apparatus 1. Substantially straight bent portions 724 which define boundaries between the supporting plates 720 and the base plates 750 are formed by the aforementioned bending process. The bent portions 724 between the supporting plates 720 and the base plate 750 extend in a substantially orthogonal direction to the bent portions 723 between the frame plate 740 and the supporting plates 720.

Figure 10:
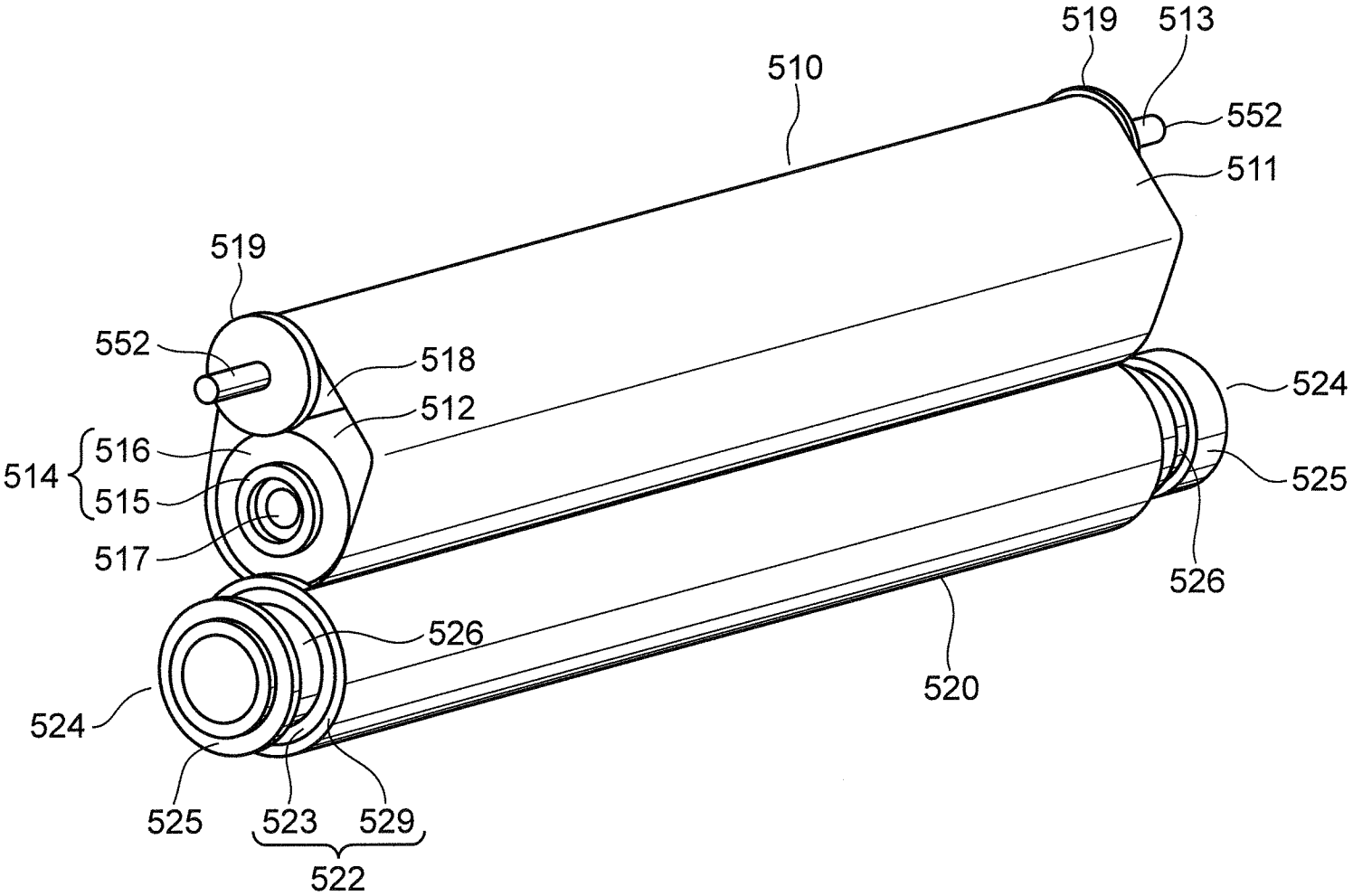
FIG. 10 is a perspective view schematically showing a belt unit and a reference roller of the roller unit shown in FIG. 9.

FIG. 10 is a perspective view of the belt unit 510 and the reference roller 520 supported by the supporting frame 710. The belt unit 510 and the reference roller 520 are described with reference to FIGS. 2, 9 and 10.

The first roller 512 of the belt unit 510 includes a substantially cylindrical first trunk 514 on which the belt 511 is wound. The first trunk 514 includes a substantially cylindrical core roller 515 and a sponge layer 516 covering the outer circumferential surface of the core roller 515 described above. The first trunk 514 compresses the belt 511 in cooperation with the reference roller 520.

Openings 517 are formed in central parts of end surfaces of the core roller 515. First journals 551 are fitted in the openings 517. As shown in FIG. 9, the first journals 551 extending from the first trunk 514 project outwardly from substantially rectangular through holes 725 formed in the supporting plates 720.

The second roller 513 of the belt unit 510 includes a substantially cylindrical second trunk 518 on which the belt 511 is wound. The second trunk 518 includes a pair of substantially disc-shaped flanges 519 beside both edges of the belt 511. The second roller 513 further includes a pair of second journals 552 projecting outwardly from the substantial centers of the paired flanges 519. The larger flanges 519 in diameter than the second trunk 518 define the widest fluctuation range of the tracking of the belt 511. It is preferable that the flanges 519 laterally position the belt 511 in between the pair of flanges 519.

As shown in FIG. 9, the second journals 552 are placed in substantially U-shaped notches 727 formed in edges 726 of the supporting plates 720 at an opposite side to the bent portions 724. Thus the belt unit 510 is appropriately supported on the supporting frame 710. In this embodiment, the edges 726 of the supporting plates 720 are exemplified as peripheral edges configured to support the second journals 522.

The reference roller 520 includes a substantially cylindrical third trunk 522. The third trunk 522 includes a core roller 523 and a sponge layer 529 covering the circumferential surface of the core roller 523 described above. The third trunk 522 presses a sheet S passing between the sponge layer 529 and the belt 511.

The reference roller 520 includes third journals 524 projecting from end surfaces of the core roller 523. As shown in FIG. 9, each third journal 524 includes a disc 525 which appears on the outer surface of the supporting plate 720. An annular groove 526 is formed between each disc 525 and the third trunk 522.

As shown in FIG. 9, the third journals 524 are fitted into openings formed in the supporting plates 720. Edges of the supporting plates 720 defining the contours of the openings, into which the third journals 524 are fitted, engage with the grooves 526 formed on the third journals 524.

The first supporting plate 721, the second supporting plate 722 and the frame plate 740 shown in FIG. 9 define an accommodation space for accommodating the first, second and third trunks 514, 518, 522.

Figure 11:
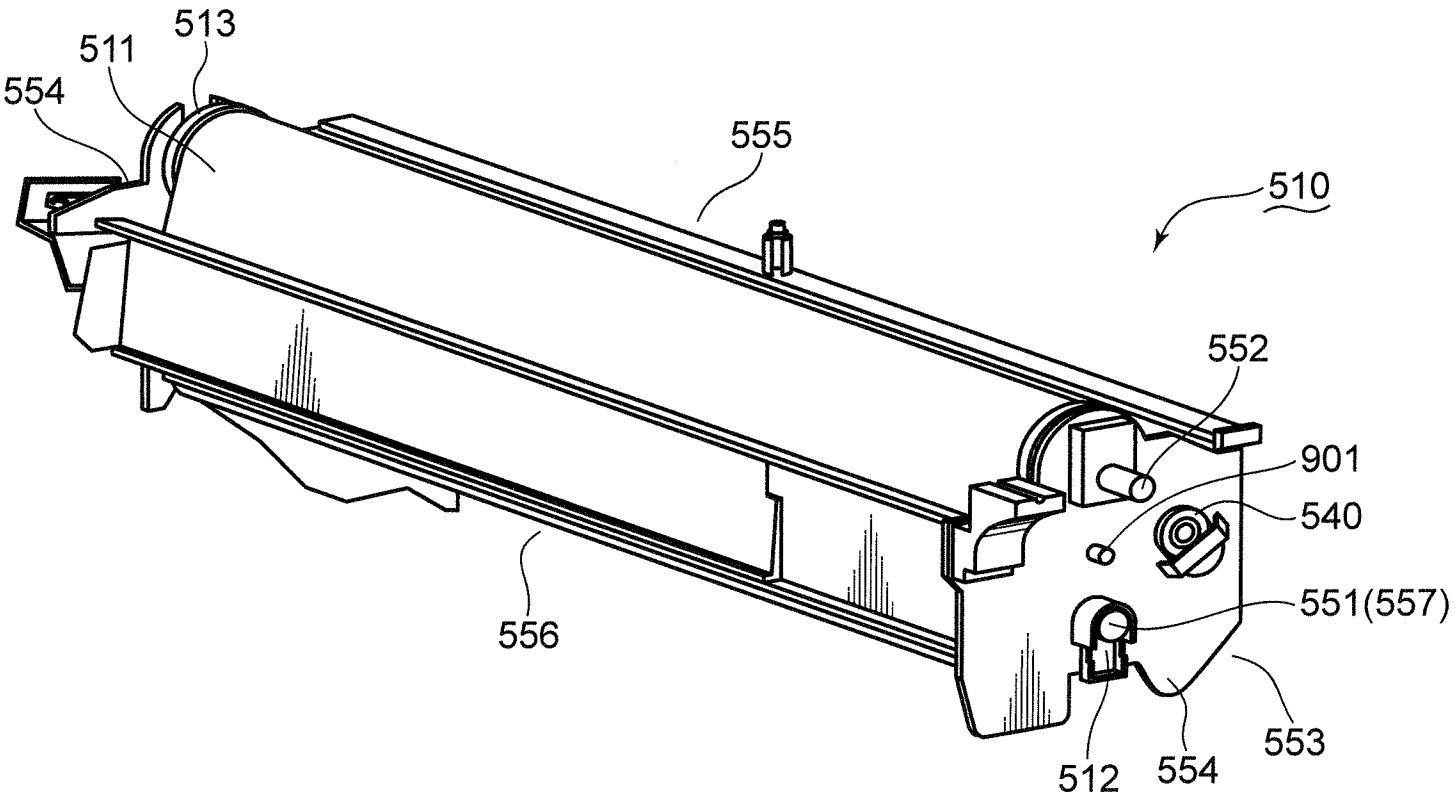
FIG. 11 is a schematic perspective view of the belt unit shown in FIG. 10.

FIG. 11 is a schematic perspective view of the belt unit 510. The belt unit 510 is described with reference to FIGS. 2, 10 and 11.

The belt unit 510 includes a holding frame 553 which integrally holds the belt 511, the first roller 512, the second roller 513 and the tension roller 540. The holding frame 553 includes a pair of side walls 554, which extend along end surfaces of the first and second trunks 514, 518, and entrance and exit walls 555, 556 which extend between the paired side walls 554. The entrance wall 555 is located at an upstream side of the exit wall 556 in a conveying direction of a sheet S. The paired side walls 554 support the first and second rollers 512, 513 so that the rotation axes of the first and second rollers 512, 513 become parallel. The first journals 551 of the first roller 512 and the second journals 552 of the second roller 513 project outwardly from the paired side walls 554.

Figure 12:
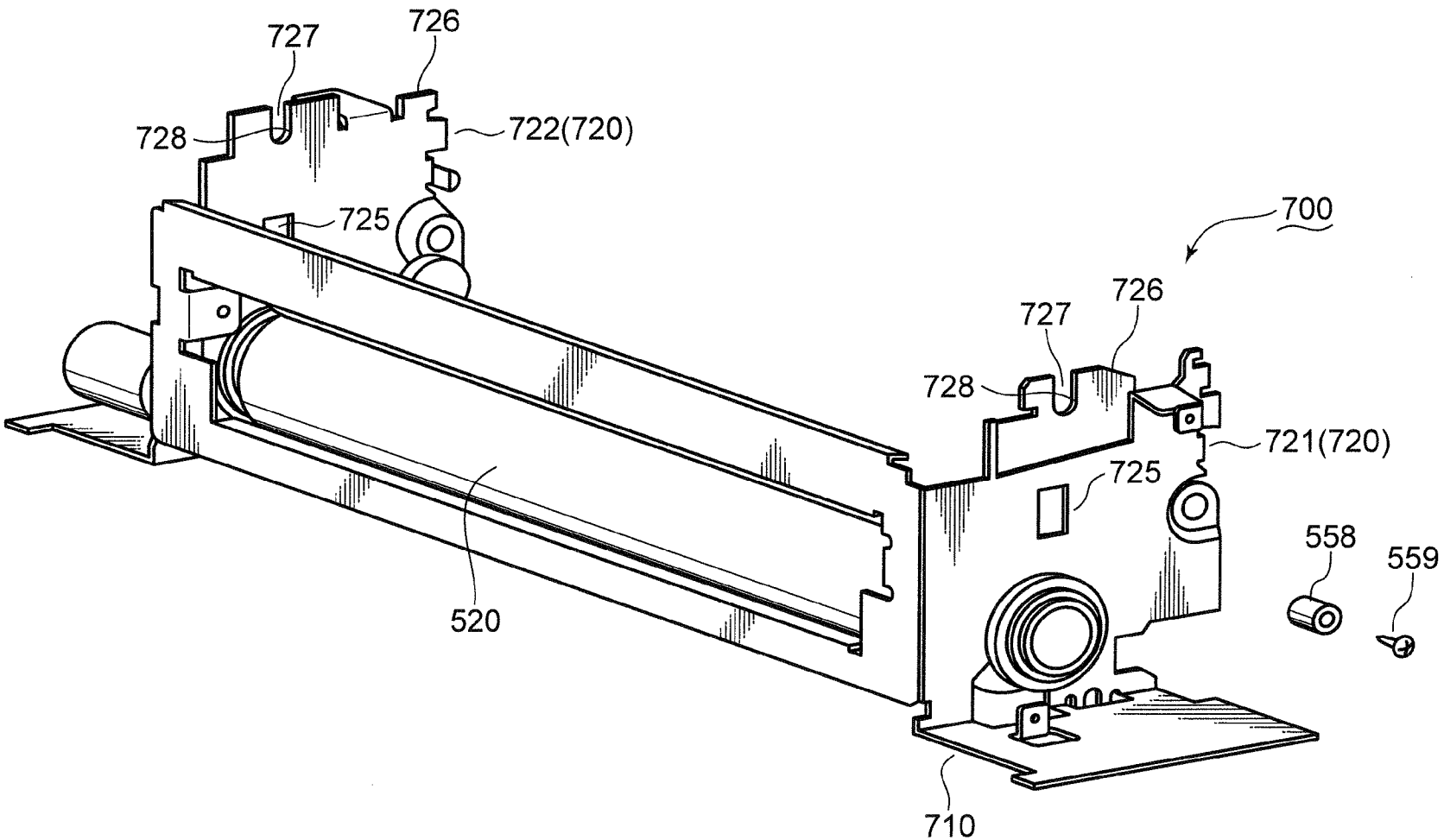
FIG. 12 is a schematic perspective view of the roller unit before mounting the belt unit shown in FIG. 11.
Figure 13:
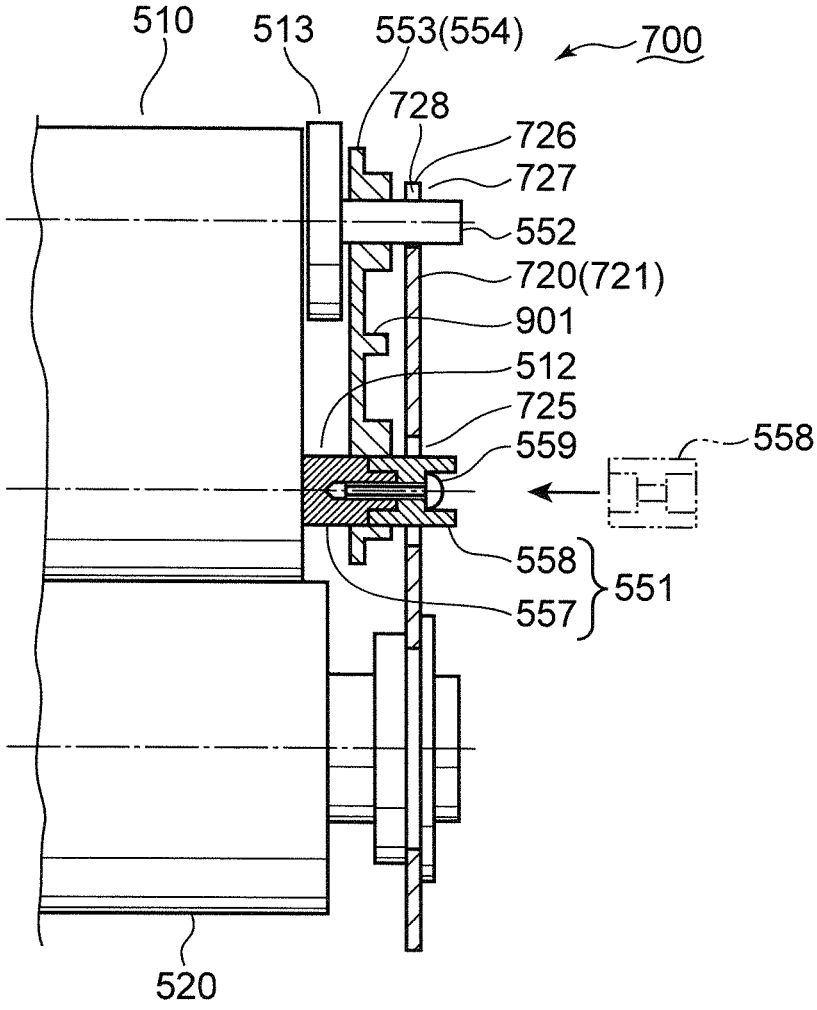
FIG. 13 is a schematic sectional view of the roller unit after mounting the belt unit shown in FIG. 11.

FIG. 12 is a schematic perspective view showing the roller unit 700 before the belt unit 510 is mounted. FIG. 13 is a schematic sectional view of the roller unit 700 after the belt unit 510 is mounted. Assembly of the belt unit 510 with the roller unit 700 is described with reference to FIGS. 10 to 13.

The substantially U-shaped notches 727 are formed in the edges 726 of the first and second supporting plates 721, 722. The second journals 552 of the second roller 513 are placed in the notches 727.

The substantially rectangular through holes 725 are formed in the first and second supporting plates 721, 722. Each first journal 551 includes a base journal 557, which is fitted into the opening 517 formed in the end surface of the first trunk 514, and a detachable journal 558, which is attached to the tip of the base journal 557. The base and detachable journals 557, 558 are connected by a suitable fixing piece 559 (e.g. a bolt).

When only the base journals 557 are attached to the first trunk 514, the entire length of the first roller 512 is shorter than the distance between the first and second supporting plates 721, 722. Accordingly, it is less likely that the first roller 512 interferes with the supporting plates 720 when the belt unit 510 shown in FIG. 11 is placed into an accommodation space, which is defined by the first supporting plate 721, the second supporting plate 722 and the frame plate 740, from above the supporting frame 710.

After the second journals 552 of the second roller 513 are supported on notch edges 728 of the notches 727, the detachable journals 558 are inserted into the through holes 725. Thereafter, the detachable journals 558 are fixed to the base journals 557 by the fixing pieces 559.

A user may detach the detachable journals 558 from the base journals 557 by removing the fixing pieces 559. Thereafter, the user may easily separate the belt unit 510 from the supporting frame 710. In this embodiment, the base journals 557 may be detached from the first trunk 514. Alternatively, the base journals 557 may be integrally formed to the first trunk 514.

As described above, the first journals 551 at least partially detachable from the first trunk 514 makes it easier to attach and detach the belt unit 510 to/from the frame 710.

(Biasing Structure)

Figure 14:
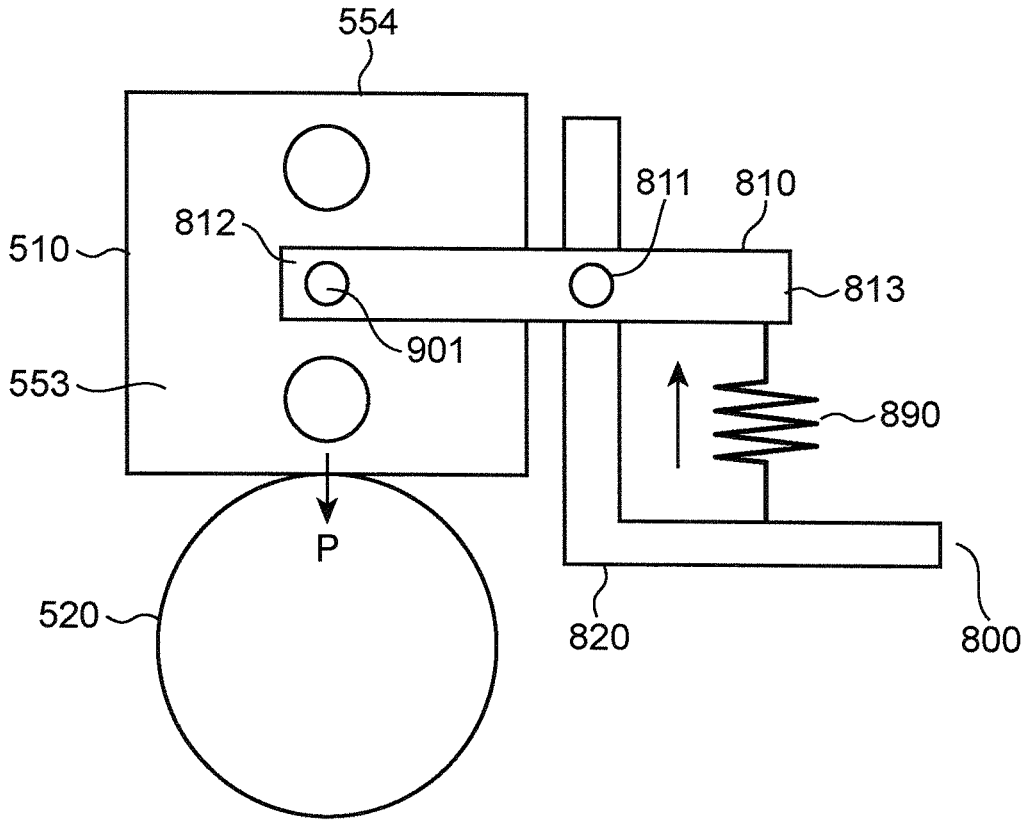
FIG. 14 is a schematic view of a biasing structure configured to bias the belt unit shown in FIG. 11 toward the reference roller.

FIG. 14 is a schematic view of a biasing structure configured to bias the belt unit 510 in a pressing direction toward the reference roller 520. The biasing structure is described with reference to FIGS. 1, 2, 11, 12 and 14. It should be noted that FIG. 14 shows exemplified methodologies of the biasing structure, therefore another structure may be employed as the biasing structure.

The biasing structure 800 causes a pressure required to fix a toner image to a sheet S between the belt unit 510 and the reference roller 520. The biasing structure 800 includes a lever element 810 with a first end 812 pivotally connected to the side wall 554 of the holding frame 553. The first end 812 may be pivotally connected to a pin 901 (see FIGS. 11 and/or 13) projecting from the outer surface of the side wall 554 of the holding frame 553. The lever element 810 includes a supporting shaft 811 pivotally connected to a holding element 820. The holding element 820 may be, for example, a bracket mounted on the holding frame 553, a bracket mounted on the supporting frame 710, a bracket mounted on the housing 2 of the image forming apparatus 1 or the housing 2 of the image forming apparatus 1 itself.

The biasing structure 800 further includes a biasing element 890 (e.g. spring) with a base end connected to the holding element 820 and a tip connected to the lever element 810. The tip of the biasing element 890 is connected to a second end 813 opposite to the first end 812. The supporting shaft 811 of the lever element 810 is provided between the first and second ends 812, 813.

The biasing element 890 biases the second end 813 in a direction opposite to a pressing direction P for pressing the belt unit 510 toward the reference roller 520. As a result, a pressure required to fix a toner image to a sheet S is generated between the belt unit 510 and the reference roller 520.

(Supporting Frame)

Figure 15:
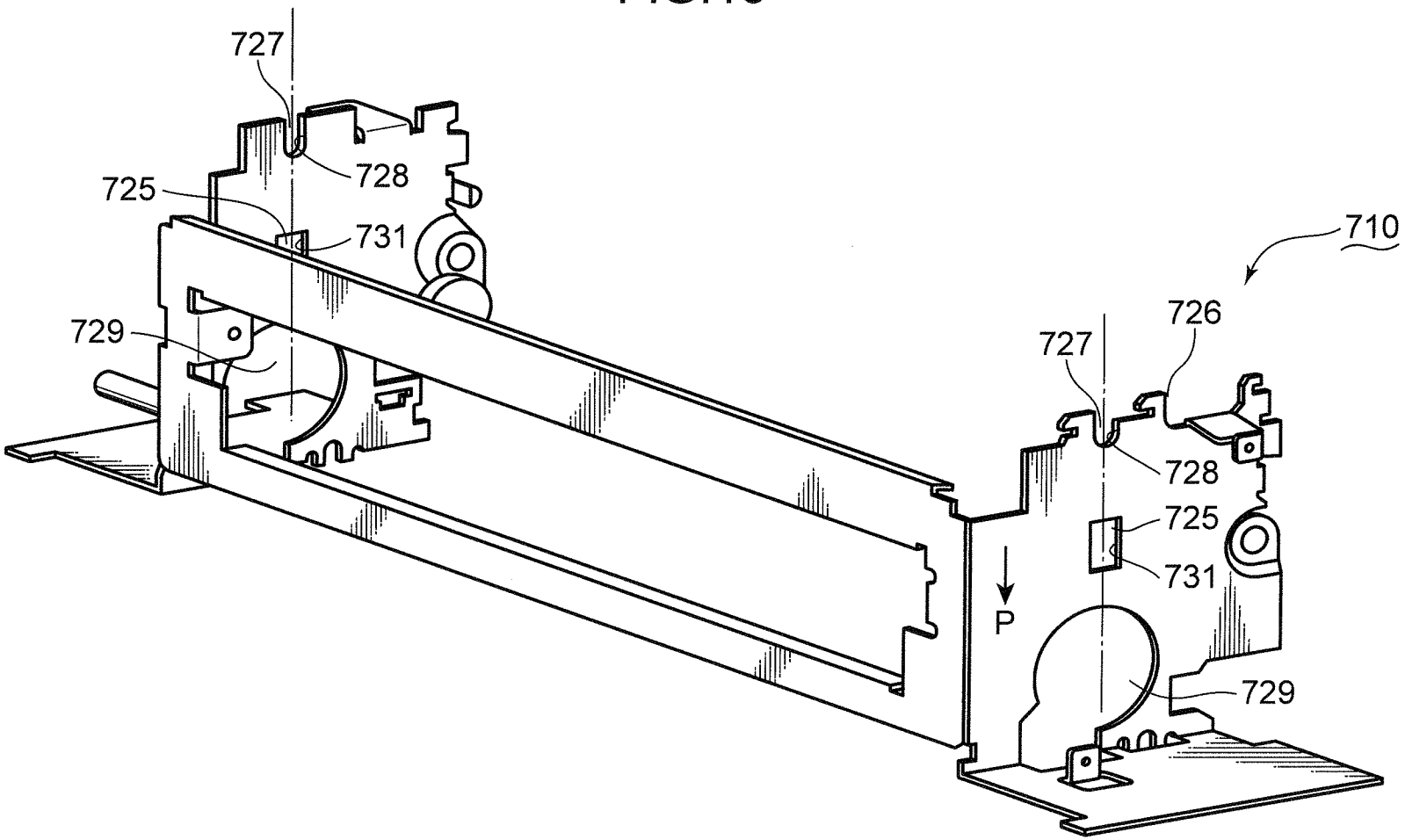
FIG. 15 is a schematic perspective view of a supporting frame of the roller unit shown in FIG. 9.

FIG. 15 is a schematic perspective view of the supporting frame 710. The supporting frame 710 is described with reference to FIGS. 2, 10, 14 and 15.

Each supporting plate 720 of the supporting frame 710 is formed with an opening 729 used to mount the third journal 524 of the reference roller 520. The substantially rectangular through-hole 725, of which contour is determined by a profiling edge 731, and the substantially U-shaped notch 727 are formed above the opening 729. The opening 729, the through-hole 725 and the notch 727 are substantially aligned in a straight line.

The profiling edges 731 and the notch edges 728 aligned in the pressing direction P for pressing belt unit 510 toward the reference roller 520 restrict a displacement of the belt unit 510 in an intersectional direction (conveying direction of the sheet S) with the pressing direction P. Accordingly, it is preferable that the through-holes 725 and the notches 727 are highly accurately formed on the basis of the openings 729.

As described above, the supporting frame 710 according to this embodiment is formed of one metal plate. Thus, a parallelism tolerance of the rotation axes of the first and second rollers 512, 513 with respect to the rotation axis of the reference roller 520 becomes less than 0.1 mm under standard perforation and/or bending processes.

As described above, the supporting frame 710 according to this embodiment suitably achieves decreased offsets of the rotation axes among the reference roller 520, the first roller 512 and the second roller 513 in the conveying direction of the sheet S. Meanwhile it is less likely that the through-holes 725 and the notches 727 extending in the pressing direction P prevents the biasing structure 800 from generating a pressure between the belt unit 510 and the reference roller 520.

Figure 16:
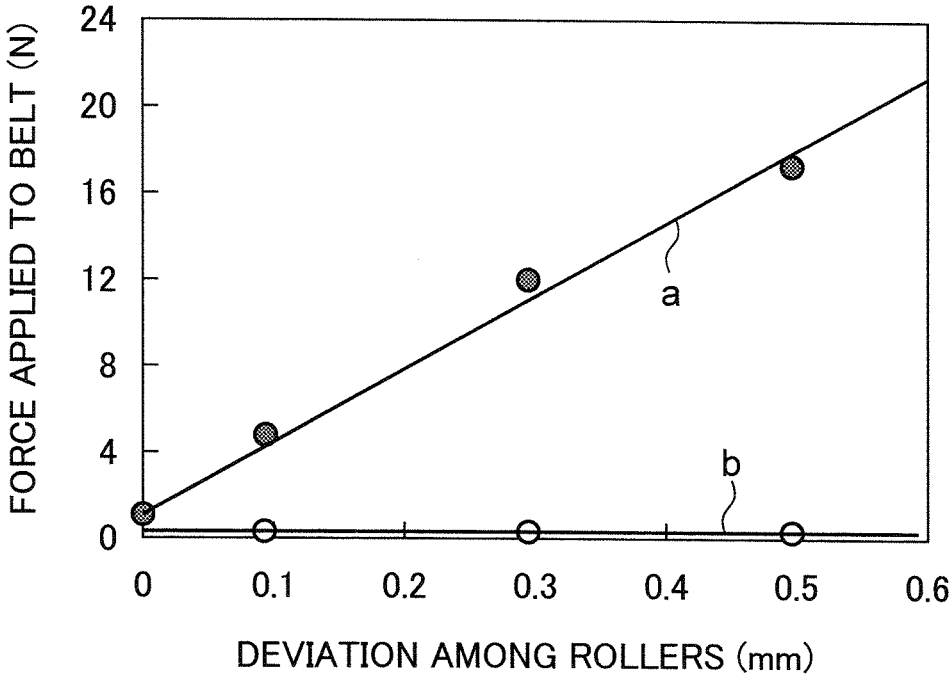
FIG. 16 is a graph showing the influence of a mounting tolerance of the belt unit on the reference roller shown in FIG. 10 on the meander of a belt.

FIG. 16 is a graph showing influence of the rotation axis offsets among the reference roller 520, the first roller 512 and the second roller 513 on the meander of the belt 511. A horizontal axis of the graph in FIG. 16 represents offset amounts (mm) of the rotation axes of the first and second rollers 512, 513 with respect to that of the reference roller 520. A vertical axis of the graph in FIG. 16 represents a force (N) applied to the belt 511 in an orthogonal direction to a travel direction of the belt 511. The influence of the rotation axis offsets among the reference roller 520, the first roller 512 and the second roller 513 on the meander of the belt 511 is described with reference to FIGS. 9 and 16.

Two regression lines "a", "b" are shown in the graph of FIG. 16. The regression line "a" indicates variation of the force applied to the belt 511 resulting from a change in the offset amount of the rotation axes among the reference roller 520, the first roller 512 and the second roller 513 in a direction of arrow A (direction along the pressing direction P) shown in FIG. 9. The regression line "b" indicates variation of the force applied to the belt 511 resulting from a change in the offset amount of the rotation axes among the reference roller 520, the first roller 512 and the second roller 513 in a direction of arrow B (direction along the conveying direction of the sheet S) shown in FIG. 9.

It is figured out from the graph of FIG. 16 that the force applied to the belt 511 dramatically goes down under less offset of the belt unit 510 in the intersectional direction with the pressing direction P. Thus, a small dimensional tolerance in the intersectional direction with the pressing direction P largely contributes to a reduction in the meander amount of the belt 511. On the other hand, it is likely that the meander amount of the belt 511 is less sensitive to the offset of the belt unit 510 in the direction along the pressing direction P. Accordingly, it should be understood that even if there is offset of the belt unit 510 in the direction along the pressing direction P, the toner image fixing process and the following conveying process of the sheet S are hardly affected.

Thus the fixing unit 500 according to this embodiment appropriately decreases the meander of the belt 511.

The fixing unit 500 according to this embodiment includes the IH coil unit 530. Alternatively, another heating mechanism configured to heat the belt 511 and/or the second roller 513 may be used instead of the IH coil unit 530.

The fixing unit 500 according to this embodiment includes the biasing structure 800 including a lever structure. Alternatively, another known mechanism configured to cause a pressure between the belt unit 510 and the reference roller 520 may be used instead of the biasing structure 800.

This application is based on Japanese Patent application No. 2010-147820 filed in Japan Patent Office on Jun. 29, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing unit for fixing a toner image formed on a sheet, comprising:

a belt unit including a belt configured to press the sheet;

a reference roller configured to nip the sheet in cooperation with the belt; and a supporting element configured to support the belt unit and the reference roller;

wherein:

the belt unit includes first and second rollers on which the belt is wound, the first roller includes a first trunk configured to compress the belt in cooperation with the reference roller, and a first journal extending from the first trunk;

the supporting element includes a supporting plate configured to support the first roller, the second roller and the reference roller, the supporting plate includes a first supporting plate and a second supporting plate facing the first supporting plate to define an accommodation space for accommodating the first trunk;

the first journal is at least partially detachable from the first trunk; and the first roller after the first journal is at least partially removed therefrom is shorter than a distance between the first and second supporting plates.

2. The fixing unit according to claim 1, wherein the first journal includes a base journal connected to the first trunk and a detachable journal attached to the base journal.

3. The fixing unit according to claim 2, wherein:

the supporting plate includes a profiling edge defining a through hole into which the first journal is inserted; and the detachable journal is attached and detached through the through hole.

4. The fixing unit according to claim 3, further comprising a biasing structure configured to bias the belt unit in a pressing direction toward the reference roller, wherein:

the profiling edge defining the through hole extending in the pressing direction restricts displacement of the belt unit in an intersectional direction with the pressing direction.

5. The fixing unit according to claim 3, wherein:

the second roller includes a second trunk on which the belt is wound, and a second journal extending from the second trunk;

the supporting plate includes a peripheral edge configured to support the second journal; and the peripheral edge defines a notch for accommodating the second journal.

6. The fixing unit according to claim 5, wherein:

the reference roller includes a third trunk configured to press the sheet and a third journal extending from the third trunk;

the supporting plate is formed with an opening for accommodating the third journal; and the through hole, the notch and the opening are aligned in a straight line.

7. The fixing unit according to claim 1, wherein:

the supporting element includes a frame plate configured to define the accommodation space in cooperation with the first and second supporting plates; and bent portions are formed between the frame plate and the first supporting plate and between the frame plate and the second supporting plate.

8. The fixing unit according to claim 7, wherein the frame plate is formed with a passage opening through which the sheet passes.

9. An image forming apparatus, comprising the fixing unit according to claim 1.

* * * * *